US007649989B2

(12) United States Patent
Johnson et al.

(10) Patent No.: US 7,649,989 B2
(45) Date of Patent: Jan. 19, 2010

(54) WEARABLE TERMINAL HOLDER WITH PIVOTING D-RINGS

(75) Inventors: Eric M. Johnson, Brooklyn, NY (US); Curt Croley, Stony Brook, NY (US)

(73) Assignee: Symbol Technologies, Inc., Holtsville, NY (US)

( * ) Notice: Subject to any disclaimer, the term of this patent is extended or adjusted under 35 U.S.C. 154(b) by 495 days.

(21) Appl. No.: 11/513,469

(22) Filed: Aug. 31, 2006

(65) Prior Publication Data

US 2008/0075273 A1 Mar. 27, 2008

(51) Int. Cl.
*H04M 1/00* (2006.01)
*H04M 9/00* (2006.01)

(52) U.S. Cl. ..... 379/455; 379/446; 455/575.1

(58) Field of Classification Search ..... 379/434, 379/446, 447, 454, 455; 455/575.1; 224/663, 224/682, 22

See application file for complete search history.

(56) References Cited

U.S. PATENT DOCUMENTS

2006/0124213 A1* 6/2006 Mangano ..... 150/103
2006/0166720 A1* 7/2006 Dixon ..... 455/575.6

* cited by examiner

*Primary Examiner*—Tuan D Nguyen

(57) ABSTRACT

A wearable terminal holder device includes a curved body, a first D-ring and a second D-ring. The curved body has a first side and a second side with a longitudinal axis bisecting the first and second sides. The first D-ring is pivotally coupled to the first side of the body. The second D-ring is pivotally coupled to the second side of the body.

19 Claims, 6 Drawing Sheets

WEARABLE TERMINAL HOLDER WITH PIVOTING D-RINGS

BACKGROUND

Conventional mobile terminals are used in a variety of environments. In certain situations, it is advantageous to have the mobile terminals worn on an area of the body, particularly a limb. Conventional technology allows mobile terminals to be worn using straps, clips, etc. However, sometimes, this technology does not allow a user to comfortably wear the mobile terminal. One cause is the differences in width of the limb of the user, not only the differences between users, but also within a single user. For example, within a single user, those skilled in the art will understand that the girth of an arm generally increases from the wrist to the elbow.

Although conventional designs allow for a "one size fits all" scheme, there is usually an optimal size for use of the wearing mechanism. Conventional technology employs straps to circumnavigate an arm to hold the mobile terminal in place. Often, these straps are adjustable to fit a user's arm width. In addition, these straps are usually connected to the wearing mechanism at right angles. Conventional designs usually limit the arm with which the wearing mechanism may be worn or are designed with a standard architecture that is not compatible with every user's arm specifications.

SUMMARY OF THE INVENTION

The present invention relates to a wearable terminal holder device which includes a curved body, a first D-ring and a second D-ring. The curved body has a first side and a second side with a longitudinal axis bisecting the first and second sides. The first D-ring is pivotally coupled to the first side of the body. The second D-ring is pivotally coupled to the second side of the body.

DETAILED DESCRIPTION

Figure 1:
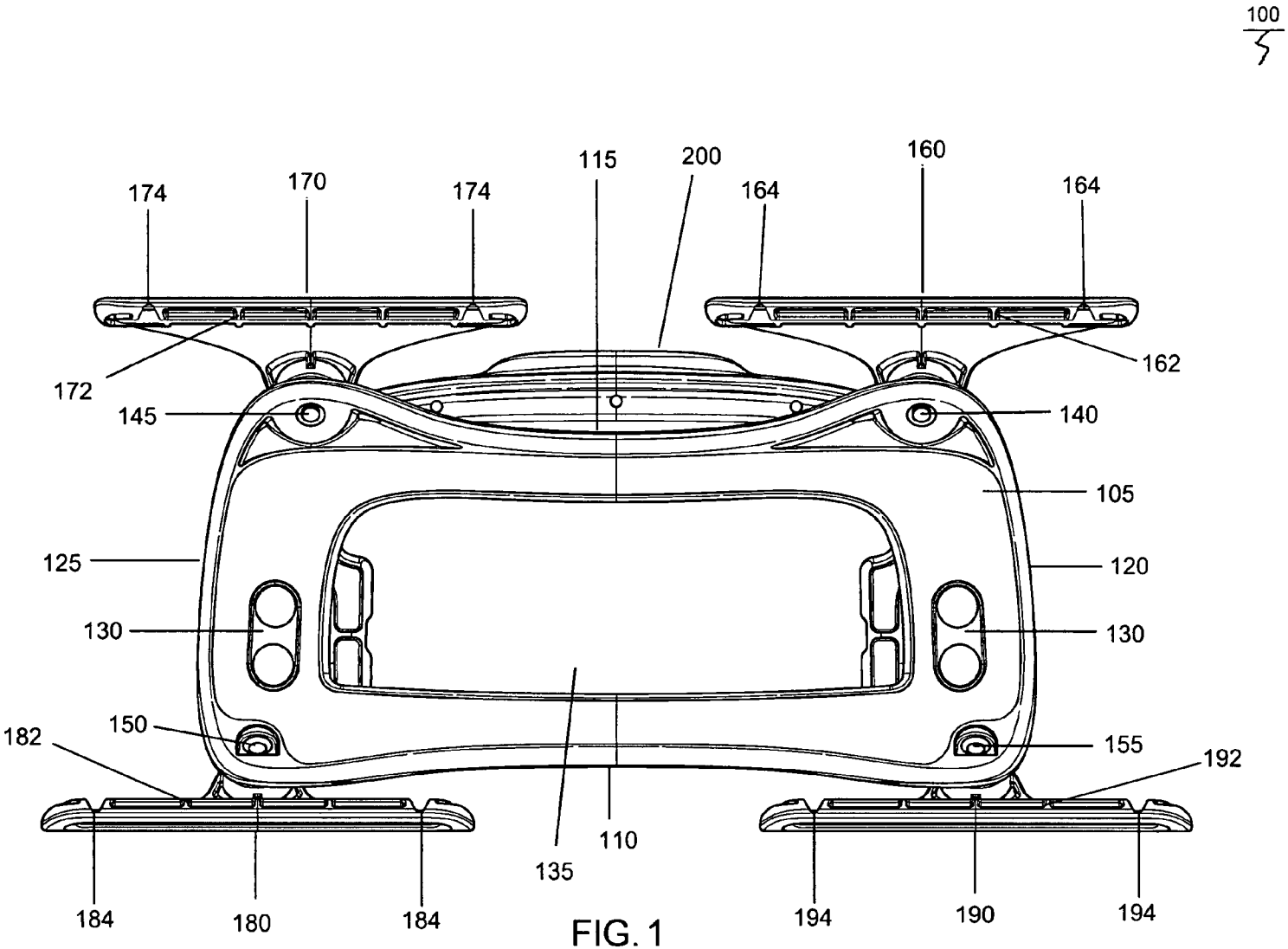
FIG. 1 shows a bottom view of a wearable terminal holder with pivoting D-rings according to an exemplary embodiment of the present invention.

The present invention may be further understood with reference to the following description and the appended drawings, wherein like elements are referred to with the same reference numerals. The exemplary embodiment of the present invention describes a wearable terminal holder (hereinafter "terminal holder") with pivoting D-rings. The terminal holder and D-rings will be discussed in detail below.

It should be noted that the following description will describe the use of the invention with respect to an arm, and, in particular, in the area around the user's wrist. However, those skilled in the art will understand that the use of a wrist is only exemplary and that the present invention may be applied to any rounded surface, both cylindrical and conical. In addition, the present invention is used on an arm so that it runs along the length of the arm.

FIG. 1 shows a bottom view of a terminal holder 100 with pivoting D-rings 160, 170, 180, 190 according to an exemplary embodiment of the present invention. In the exemplary embodiment, the terminal holder 100 includes a body 105, pivoting D-rings 160, 170, 180, 190, a window 135, connection points 140-155, attachment points 130, D-ring bars 162, 172, 182, 192, break away points 164, 174, 184, 194, and a terminal lock 200.

The body 105 of the terminal holder 100 is a central unit to which the other components of the terminal holder 100 may attach. In the exemplary embodiment, the body 105 may be manufactured of a rigid plastic. It should be noted that the use of a rigid plastic is only exemplary and that other materials may be used to manufacture the body 105. For example, the body 105 may be manufactured using tightly woven fabrics, bendable plastics, rubber, various polymers, etc.

The body 105 exhibits a substantially rectangular shape with rounded corners. The body 105 has four sides 110, 115, 120, 125. The side 110 exhibits a longer length than the opposite side 115. For example, in the exemplary embodiment, the length of side 110 is 5 inches while the length of the side 110 is 4.75 inches. However, it should be noted that the sides 110, 115 exhibiting different lengths is only exemplary and that the length of the sides 110, 115 may be equal. The sides 120 and 125 are widths of the body 105. In the exemplary embodiment, the sides 120, 125 exhibit lengths that are shorter than the length of the sides 110, 115. For example, the length of the sides 120, 125 may be about half the length of the side 110. It should be noted that the relative lengths of the sides 110-125 of the body 105 may depend on the use of the terminal holder 100. For example, for use with longer attachments, it may be preferable to allow the terminal holder 100 to extend the length of the arm, e.g., from the wrist to the elbow. In such an embodiment, the length of sides 120, 125 may be smaller than half the length of the side 110. In the exemplary embodiment, the lengths of sides 120, 125 are substantially equal. However, those skilled in the art will understand that the lengths of the sides 120, 125 may be unequal, e.g., length of side 125 is slightly greater than length of side 120. It should also be noted that the rectangular shape is only exemplary and that other shapes may exist such as symmetrical shapes (e.g., an ellipse, a square, etc.).

The sides 110-125 exhibit a curvature. The sides 120, 125 have a slight, convex curvature extending across its length. The middle of the sides 120, 125 is substantially linear and the curvature is exhibited toward the ends. The curvature creates the rounded corners of the substantially rectangular shape of the body 105. The sides 110, 115 also contribute to the rounded corners as the ends of those sides also exhibit a curvature toward the ends. The sides 110, 115 exhibit a concave curvature across its length. The side 110 has a concave curvature that is similar in steepness to the sides 120, 125, except in an opposite direction. The side 115 has a concave curvature that is steeper than the side 110. The steepness of the side 115 may depend on, for example, the terminal lock 200. It should be noted that the curvature of the sides 110-125 is not necessary and the body 105 may have sides that are linear. However, in a preferred embodiment, the corners of the body 105 exhibit a rounded shape to provide comfort for a user. The curvature of the sides 110-125 is not limited to a lateral curvature. The sides 110-125 also exhibit a depth curvature. The depth curvature will be discussed in more detail below.

In the exemplary embodiment, the body 105 includes the window 135 in a center of the body 105. The applications of the window 135 may be, for example, to provide a ventilation port for a mobile terminal that is placed on top of the terminal holder 100 using the terminal lock 200. In the exemplary embodiment, the window 135 is a substantially rectangular shape. The sides of the window 135 exhibit similar properties to the body 105. For example, the side of the window 135 parallel to the side 115 of the body 105 is slightly shorter than the side of the window 135 parallel to the side 110 of the body 105. The sides of the window 135 parallel to the sides 120, 125 are substantially equal in length. The sides of the window 135 also exhibit a curvature. The curvature of the sides of the window 135 is similar to the curvature of the sides 120, 125 of the body 105, e.g., steepness, convex. The resulting widths of the body 105 are created from the window 135. The widths between the sides 120, 125 and the window 135 are substantially equal and greater than the widths between the sides 110, 115 and the window 135. The width between the window 135 and side 110 is substantially equal to the width between the window 135 and side 110 towards the middle. However, due to the steeper curvature of the side 115, the width between the window 135 and side 115 increases towards the ends. It should be noted that the use of the window 135 is only exemplary and that the body 105 may be solid or perforated.

The attachment points 130 are located on the body 105. Specifically, each attachment point 130 is on the body between the sides 120, 125 and the corresponding parallel side of the window 135. It should be noted that the location of the attachment points 130 shown in FIG. 1 is only exemplary and that the attachment points 130 may be placed anywhere on the body 105 to provide an attachment site with the terminal lock 200. The attachment points 130 provide a means to attach the terminal lock 200 onto the terminal holder 100. The attachment points 130 may be, for example, rivets, snaps, hook and loop fasteners, etc.

The pivoting D-rings 160, 170, 180, 190 are placed at each rounded corner of the body 105. The pivoting D-rings 160, 170, 180, 190 are attached to the body 105 at the connection points 140-155, respectively. In the exemplary embodiment, the connection points 140-155 are shoulder screws. The use of the shoulder screws allows the pivoting D-rings 160, 170, 180, 190 to be replaced if necessary. As illustrated, the bottoms of the connection points 140-155 are the bottoms of a screw body. It should be noted that the use of shoulder screws as the connection points 140-155 for the pivoting D-rings 160, 170, 180, 190 to the body 105 is only exemplary and that other methods may be used. For example, the connection points 140-155 may be snaps, a cylinder with tapered edges, rivets, etc.

At the bottom of the pivoting D-rings 160, 170, 180, 190 are D-ring bars 162, 172, 182, 192, respectively, and break away points 164, 174, 184, 194. The D-ring bars 162, 172, 182, 192 allow a uniform wall thickness across the bottom of the pivoting D-rings 160, 170, 180, 190. In the exemplary embodiment, the D-ring bars 162, 172, 182, 192 are rounded semi-circular extensions. The ends of the D-ring bars 162, 172, 182, 192 are the location of each pair (one on each end) of the break away points 164, 174, 184, 194, respectively. The break away points 164, 174, 184, 194 are divots that exhibit a lesser wall thickness than the D-ring bars 162, 172, 182, 192. This allows the break away points 164, 174, 184, 194 to snap and break away when, for example, too much weight is applied to the terminal holder. This prevents any potential harm that may be inflicted upon the user if excessive weight or improper use is performed using the terminal holder. The connection points 140-155, the D-ring bars 162, 172, 182, 192, the break away points 164, 174, 184, 194, and the pivoting D-rings 160, 170, 180, 190 may be manufactured using similar materials as the body 105. For example, the pivoting D-rings 160, 170, 180, 190 may be manufactured using a rigid plastic or metal to maintain its shape despite any use. In another example, the pivoting D-rings 160, 170, 180, 190 may be manufactured using a semi-rigid plastic to bend towards the surface the terminal holder 100 attaches. In another example, the D-ring bars 162, 172, 182, 192 may be manufactured using a rubber. The break away points 164, 174, 184, 194 may be manufactured of a less rigid material that is more prone to breaking away than the material used for the pivoting D-rings 160, 170, 180, 190. It should be noted that the less rigid material would still allow a user to use the terminal holder up to the predetermined capacity (e.g., weight) allowable. The connection points 140-155 and the pivoting D-rings 160, 170, 180, 190 will be discussed in more detail below. It should be noted that the placement of the pivoting D-rings 160, 170, 180, 190 at the rounded corners of the body 105 is only exemplary and that they may be placed on any part of the body 105, such as the middle. It should also be noted that the use of four pivoting D-rings 160, 170, 180, 190 is only exemplary and that the terminal holder 100 may use more or fewer D-rings depending on the size and mass of the mobile terminal that attaches.

Figure 2:
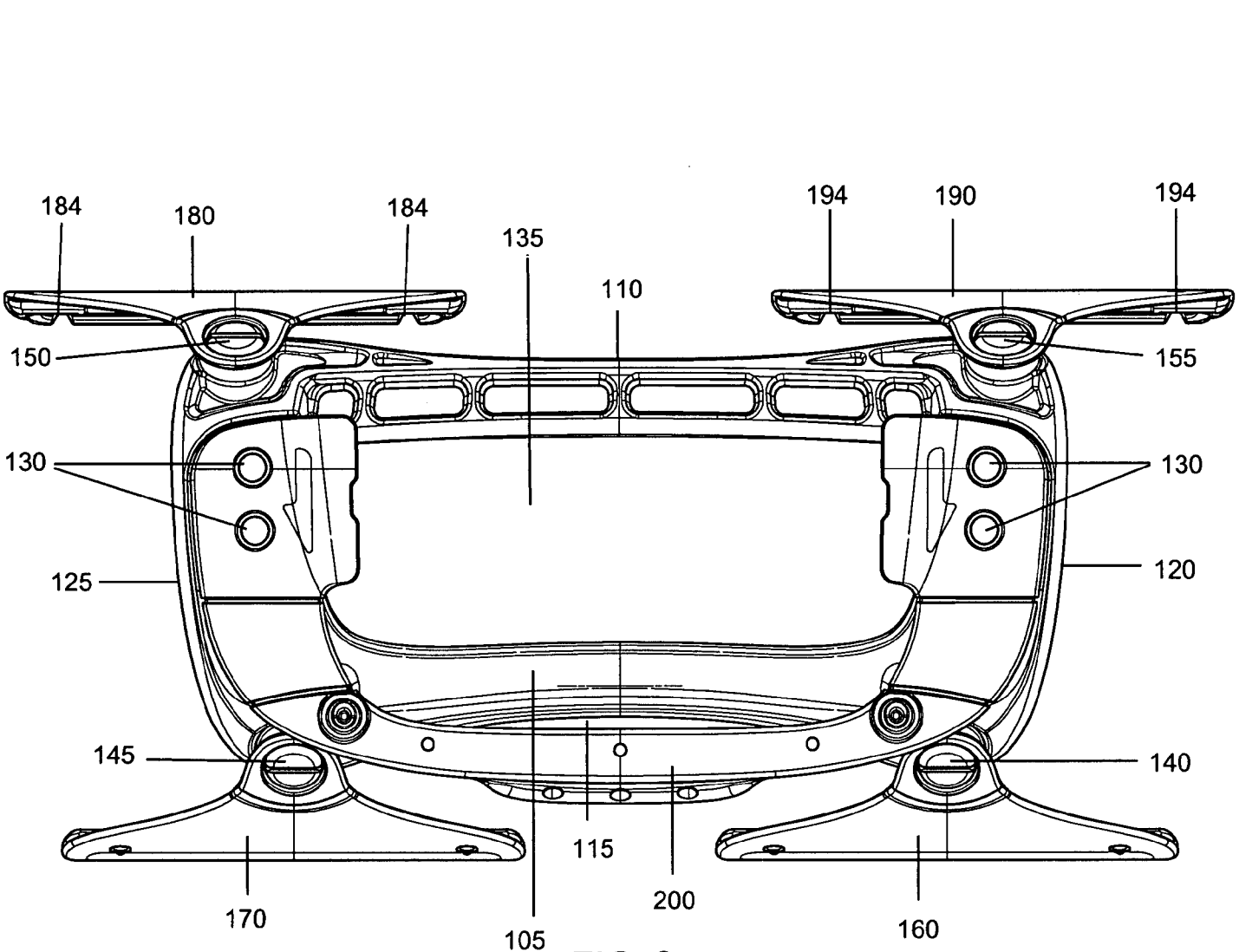
FIG. 2 shows a top view of the wearable terminal holder with pivoting D-rings shown in FIG. 1.
Figure 8:
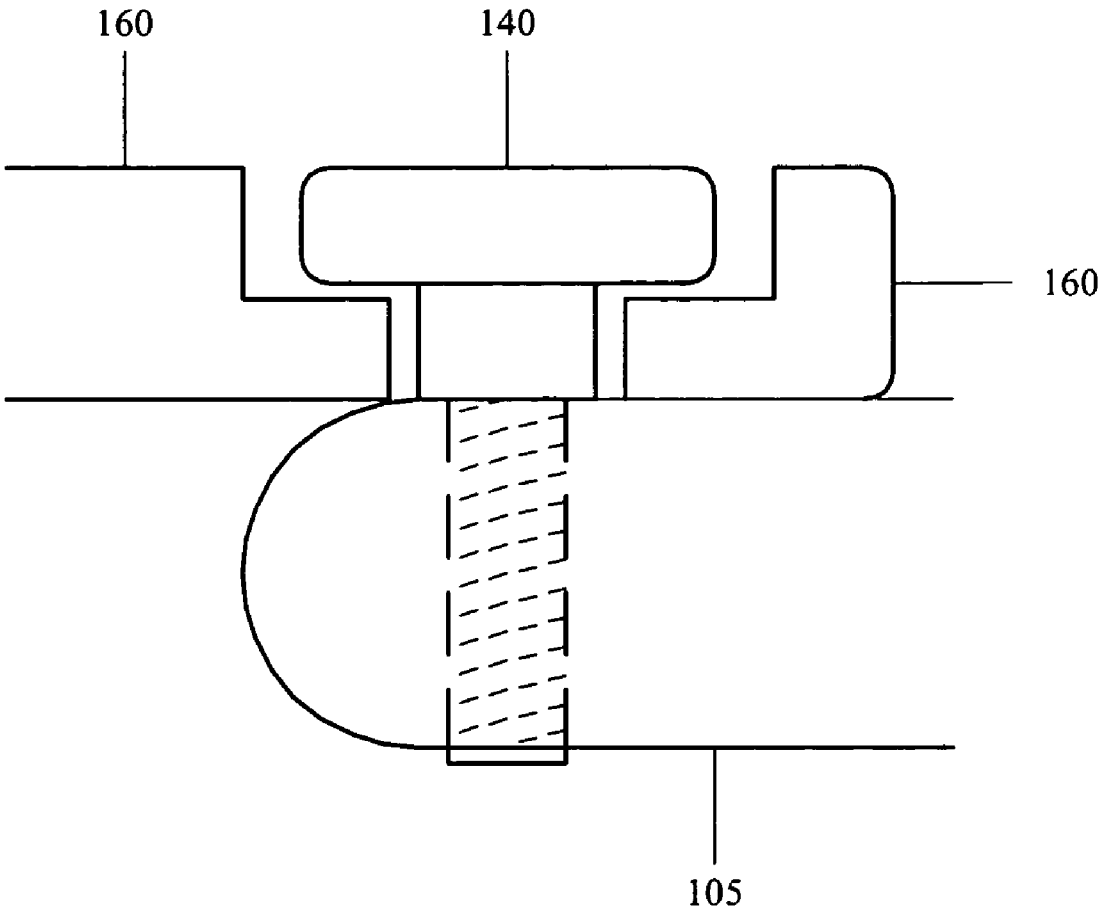
FIG. 8 shows a cross sectional view of the wearable terminal holder with pivoting D-rings shown in FIG. 1.

FIG. 2 shows a top view of the wearable terminal holder 100 with pivoting D-rings 160, 170, 180, 190 shown in FIG. 1. The top sides of the body 105, the terminal lock 200, the attachment points 130, the pivoting D-rings 160, 170, 180, 190, and the connection points 140-155 are shown. As discussed above, the connection points 140-155 are shoulder screws. Those skilled in the art will understand that shoulder screws may be fully tightened with a small cylindrical body disposed between the screw head and the screw body, as illustrated in FIG. 8. The small cylindrical body allows the pivoting D-rings 160, 170, 180, 190 to freely rotate with minimal inadvertent loosening of the shoulder screw. As illustrated in FIG. 2, the visible portions of the connection points 140-155 are the heads of the screws. A circular head is used in the exemplary embodiment. The exemplary embodiment also illustrates that the screw heads are designed for use with flat-head screwdrivers. However, it should be noted that this is only exemplary and that other designs are possible, e.g., Philips head, hex-tool, etc.

FIG. 8 shows a cross sectional view of the wearable terminal holder 100 with pivoting D-rings 160, 170, 180, 190 shown in FIG. 1. Specifically, FIG. 8 shows a cross sectional view across the connection point 140. It should be noted that this cross sectional view applies to all the connection points 140-155. The connection point 140 is shown as the shoulder screw, as discussed above. The top portion of the pivoting D-ring 160 is placed on the body 105. These two components are attached using the connection point 140. The connection point 140 traverses the width of the body 105 and extends slightly on the other side of the body 105. It should be noted that the connection point 140 extending past the width of the body 105 is only exemplary. Those skilled in the art will understand that the connection point 140 may only traverse a portion of the width of the body 105. However, the amount the connection point 140 traverses should be sufficient to guarantee that the pivoting D-ring 160 stays attached to the body 105.

Figure 3:
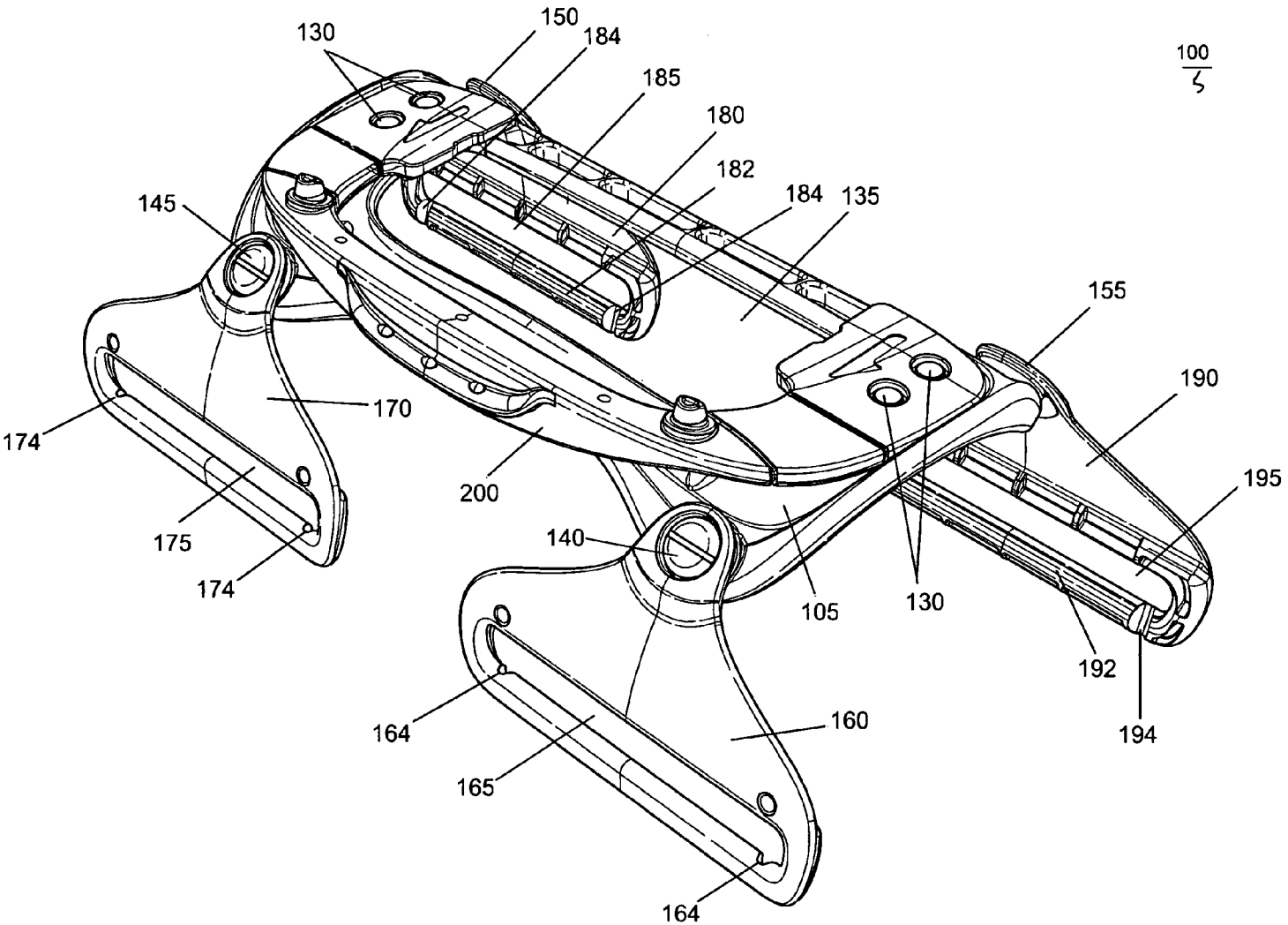
FIG. 3 shows a perspective view of the wearable terminal holder with pivoting D-rings shown in FIG. 1.

FIG. 3 shows a perspective view of the wearable terminal holder 100 with pivoting D-rings 160, 170, 180, 190 shown in FIG. 1. In FIG. 3, the curvatures of the sides 110-125 are visible. The curvature of the sides 110, 115 will be described in more detail below with reference to FIGS. 4-5. The depth curvature of the sides 120, 125 will be described in more detail below with reference to FIG. 6. FIG. 3 also shows another feature of the pivoting D-rings 160, 170, 180, 190. Slots 165, 175, 185, 195 are located towards the bottom of each pivoting D-ring 160, 170, 180, 190, respectively. The slots 165, 175, 185, 195 are flat, substantially rectangular windows. The longer sides of the window of the slots 165, 175, 185, 195 run parallel to the flat side of the pivoting D-rings 160, 170, 180, 190, respectively. The windows are designed to accept a fastening device. For example, the fastening device may be a strap. The strap would feed through slot 165 towards slot 195. Another strap would feed through slot 175 towards slot 185. In one exemplary embodiment, the strap loops back towards the originating slot and fastens. In another exemplary embodiment, the strap is fastened at the end slot. It should be noted that the straps may also be used in a cross pattern (e.g., feed through slot 165 towards 185, feed through slot 175 towards slot 195). The strap may include a fastener such as hook and loop fasteners, buckles, snaps, buttons, etc. The strap may be adjustable to accommodate different arm thicknesses. The strap may be manufactured using, for example, a flexible woven fabric, flexible plastics, cloths, etc. With a strap, if a break away point 164, 174, 184, 194 is needed, the break away point 164, 174, 184, 194 would snap, thereby releasing the strap from the terminal holder.

Figure 4:
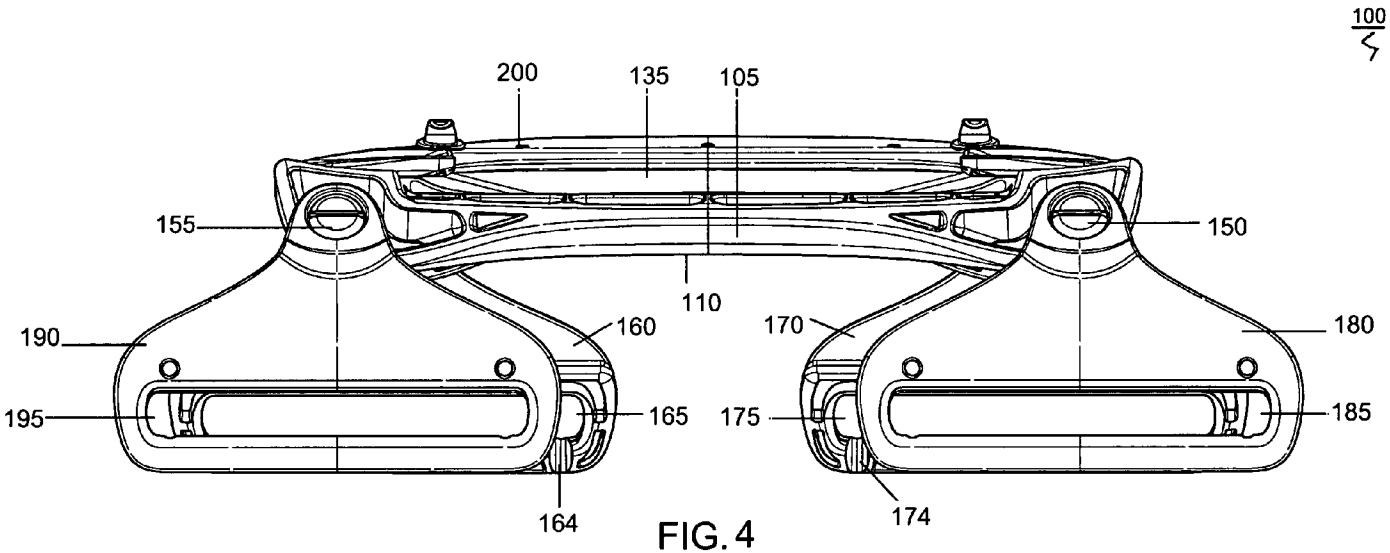
FIG. 4 shows a first side view of the wearable terminal holder with pivoting D-rings shown in FIG. 1.
Figure 5:
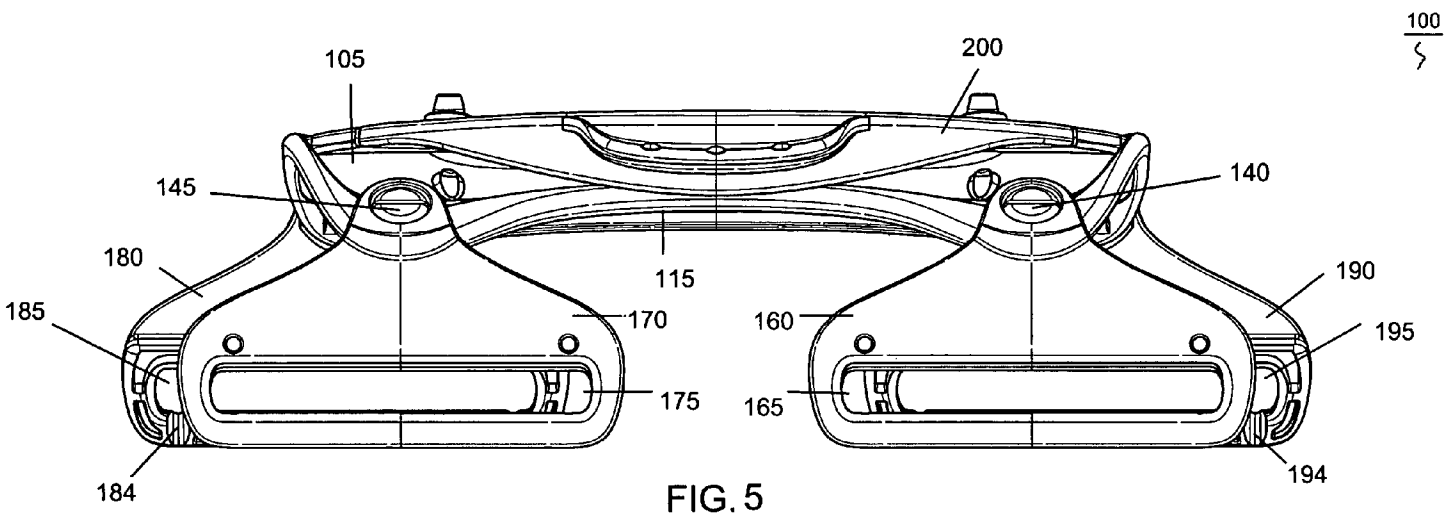
FIG. 5 shows an opposite side view of the wearable terminal holder with pivoting D-rings shown in FIG. 4.

FIGS. 4-5 show side views of the wearable terminal holder 100 with pivoting D-rings 160, 170, 180, 190 shown in FIG. 1. Specifically, FIG. 4 shows the side view with the side 110 of the body 105. FIG. 5 shows the side view with the side 115 of the body 105. As discussed above, the side 110 exhibits a slight curvature across the length while side 115 exhibits a steeper curvature across the length. The curvature of sides 110, 115 in conjunction with the above discussed curvature of sides 120, 125 allow the pivoting D-rings 160, 170, 180, 190 to rotate around the connection points 140-155, respectively. In addition, the curvatures of the sides 110-125 allow the rounded corners of the body 105 to extend slightly which further allows a rotation of the pivoting D-rings 160, 170, 180, 190. The body of the connection points 140-155 (either screw body or cylinder) is substantially round to allow the free range of rotation. In the exemplary embodiment, the pivoting D-rings 160, 170, 180, 190 may rotate around the connection points 140-155, respectively, approximately 120°. Those skilled in the art will understand that the shape of the pivoting D-rings 160, 170, 180, 190, the curvature of the body 105, etc. prevent a full 360° rotation around the connection points 140-155 in the exemplary embodiment. However, those skilled in the art will also understand that the terminal holder 100 may be designed to incorporate a greater or lesser degree of rotation for the pivoting D-rings 160, 170, 180, 190 around the connection points 140-155, respectively. The rotation around the connection points 140-155 allow the terminal holder 100 to adjust to the shape of the surface it is attached, especially around the wrist of a user. The connection points 140-155 allow conical surfaces as well. For example, the pivoting D-rings 160, 190 located near a thick area of an arm may stay perpendicular to the body 105 while the pivoting D-rings 170, 180 located near a thin area of the arm rotates slightly to adjust to the difference in thickness. As discussed above, using, for example, an octagonal screw head, the pivoting D-rings 160, 170, 180, 190 may rotate at 45°.

Figure 6:
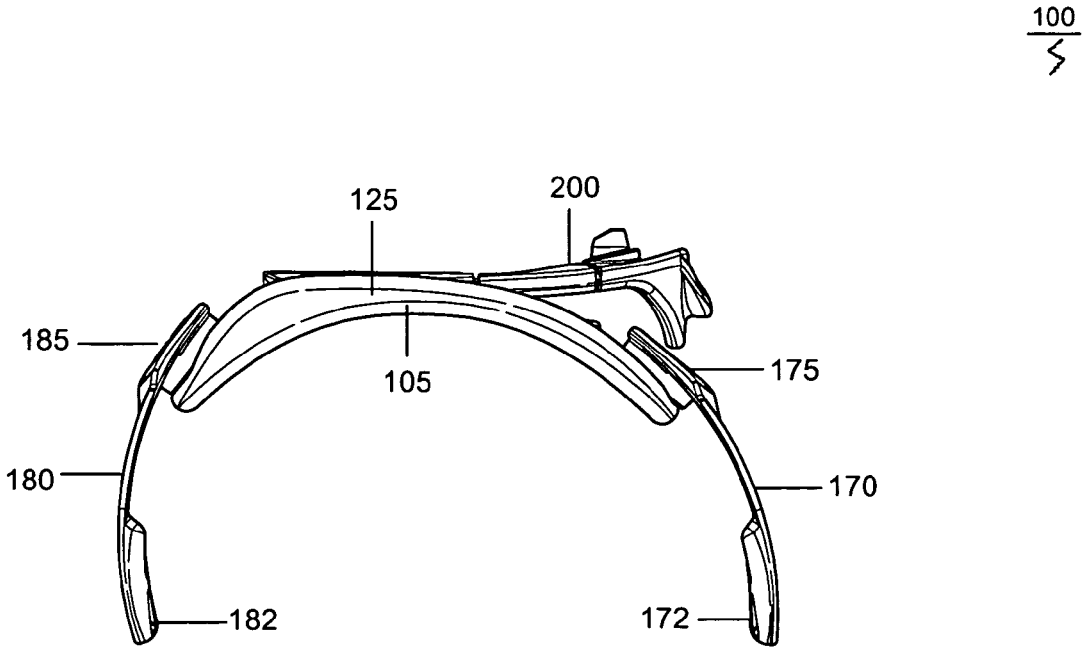
FIG. 6 shows a second side view of the wearable terminal holder with pivoting D-rings shown in FIG. 1.
Figure 7:
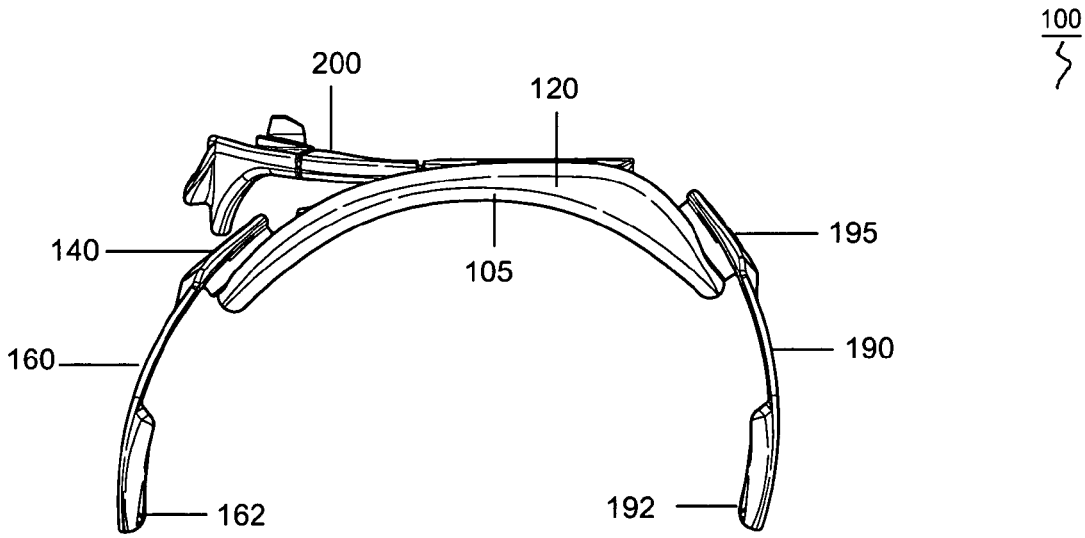
FIG. 7 shows an opposite side view of the wearable terminal holder with pivoting D-rings shown in FIG. 6.

FIGS. 6-7 show side views of the wearable terminal holder 100 with pivoting D-rings 160, 170, 180, 190 shown in FIG. 1. Specifically, FIG. 6 shows the side with the side 125 of the body 105. FIG. 7 shows the side with the side 120 of the body 105. As discussed above, sides 120, 125 exhibit a curvature along the length but also exhibit a depth curvature. These depth curvatures of sides 120, 125 are visible on FIGS. 6-7. The depth curvatures allow the terminal holder 100 to conform more easily to a wrist or other rounded surface to which the terminal holder 100 attaches. However, it should be noted that the depth curvature of the exemplary embodiments is only exemplary and the terminal holder 100 may have a flat body 105.

The wearable terminal holder 100 according to the exemplary embodiment of the present invention may be used in conjunction with a wearable pad (not shown). The wearable pad may face an inner surface of the body 105, to be disposed in between the surface to which the terminal holder 100 attaches and the terminal holder 100. The wearable pad may, for example, attach directly to the inner surface of the body 105 or be a wholly separate device that is merely placed on the surface to which the terminal holder 100 attaches. The wearable pad may function to add comfort for a user using cushions, prevent rotation of the terminal holder 100, etc.

It will be apparent to those skilled in the art that various modifications may be made in the present invention, without departing from the spirit or scope of the invention. Thus, it is intended that the present invention cover the modifications and variations of this invention provided they come within the scope of the appended claims and their equivalents.

What is claimed is:

1. A wearable terminal holder device for a portable communication device, comprising:

a curved body having a first side and a second side with a longitudinal axis bisecting the first and second sides;

a first D-ring pivotally coupled to the first side of the body;

a second D-ring pivotally coupled to the second side of the body; and a latching mechanism for attaching the portable communication device to a top surface of the terminal holder.

2. The wearable terminal holder device of claim 1, further comprising:

a third D-ring pivotally coupled to the first side of the body; and a fourth D-ring pivotally coupled to the second side of the body.

3. The wearable terminal holder device of claim 2, wherein the first D-ring is pivotally coupled to a first end of the first side, the third D-ring is pivotally coupled to a second end of the first side, the second D-ring is pivotally coupled to a first end of the second side, and the fourth D-ring is pivotally coupled to a second end of the second side.

4. The wearable terminal holder device of claim 1, wherein the device is a mobile terminal holder.

5. The wearable terminal holder device of claim 1, further comprising:

a strap coupled to the first D-ring and second D-ring, the strap securing the device to an object.

6. The wearable terminal holder device of claim 1, wherein the first D-ring is pivotally coupled to the first side of the body by one of screws, tapered cylinders, and rivets.

7. The wearable terminal holder device of claim 1, wherein the body includes a window.

8. The wearable terminal holder device of claim 1, wherein the body includes a locking mechanism.

9. The wearable terminal holder device of claim 1, wherein the body includes a terminal lock.

10. The wearable terminal holder device of claim 1, further comprising:

a wearable pad disposed between an inner surface of the body and an object.

11. The wearable terminal holder device of claim 1, wherein the latching mechanism is a terminal lock holding the portable communication device.

12. The wearable terminal holder device of claim 1, wherein the D-rings further include a break away point.

13. The wearable terminal holder device of claim 1, further comprising a window in a center of the curved body, wherein the window provides a ventilation port for the portable communication device.

14. A wearable terminal holder device for a portable communication device, comprising:

a curved body having a first side and a second side with a longitudinal axis bisecting the first and second sides;

a first pair of D-rings pivotally coupled to the first side of the body;

a second pair of D-rings pivotally coupled to the second side of the body; and a latching mechanism for attaching the portable communication device to a top surface of the terminal holder.

15. The wearable terminal holder device of claim 14, wherein the first pair of D-rings lies on a first line that is substantially parallel to a second line on which the second pair of D-rings lies.

16. The wearable terminal holder device of claim 14, further comprising:

a strap coupled to one D-ring of the first pair and one D-ring of the second pair, the strap securing the device to an object.

17. The wearable terminal holder device of claim 14, further comprising a window in a center of the curved body, wherein the window provides a ventilation port for the portable communication device.

18. A wearable terminal holder device for a portable communication device, comprising:

a body means for receiving a limb of a user and providing an attachment means for coupling a mobile device to the body means;

a first securing means coupled to a first side of the body means for receiving a connection means, the connection means connecting the body means to the limb of the user;

a second securing means coupled to a second side of the body means for receiving the connection means; and a latching means for attaching the portable communication device to a top surface of the terminal holder, wherein the first securing means and the second securing means each comprise a pair of d-rings coupled to the body means.

19. The wearable terminal holder device of claim 18, further comprising a ventilation means coupled to the body means for providing a ventilation port for the portable communication device.

* * * * *